US008454267B2

(12) United States Patent
Ireland

(10) Patent No.: US 8,454,267 B2
(45) Date of Patent: Jun. 4, 2013

(54) SEAMLESS, DOUBLE WALLED SUMP

(75) Inventor: Steven Ireland, Long Beach, CA (US)

(73) Assignee: CRP Tank Specialties, Inc., Signal Hill, CA (US)

( * ) Notice: Subject to any disclaimer, the term of this patent is extended or adjusted under 35 U.S.C. 154(b) by 0 days.

(21) Appl. No.: 13/219,292

(22) Filed: Aug. 26, 2011

(65) Prior Publication Data

US 2013/0051916 A1 Feb. 28, 2013

(51) Int. Cl.
*F17C 13/08* (2006.01)

(52) U.S. Cl.
USPC ..... 405/52; 220/560.03

(58) Field of Classification Search
USPC ..... 405/52, 54; 220/560.03
See application file for complete search history.

(56) References Cited

U.S. PATENT DOCUMENTS

| | | | | |
|---|---|---|---|---|
| 5,000,342 | A * | 3/1991 | Sharp | 220/567.1 |
| 5,368,670 | A * | 11/1994 | Kauffman | 156/171 |
| 5,494,183 | A * | 2/1996 | Sharp | 220/62.19 |
| 5,589,631 | A * | 12/1996 | Spring et al. | 73/49.2 |
| 6,551,024 | B1 * | 4/2003 | Berg et al. | 405/54 |
| 6,729,797 | B2 * | 5/2004 | Manger et al. | 405/52 |
| 7,229,233 | B2 * | 6/2007 | Burwell et al. | 405/52 |

* cited by examiner

*Primary Examiner* — Tara M. Pinnock
(74) *Attorney, Agent, or Firm* — Fulwider Patton LLP

(57) ABSTRACT

A seamless, double-walled sump is disclosed for collecting run-off materials and waste products. The sump includes a primary containment vessel and a secondary vessel, integrally molded into a single seamless unit. The sump includes a plurality of ribs that cooperate with surrounding concrete or other enclosing material to anchor the sump and prevent floating. The sump may also include a fabric outer layer that serves as an interface between the concrete and the sump to prevent corrosion.

1 Claim, 2 Drawing Sheets

SEAMLESS, DOUBLE WALLED SUMP

BACKGROUND

Sumps, also referred to as catch basins, have traditionally been utilized in chemical, petrochemical, metal finishing, industrial and municipal operations to capture the flow of hazardous materials. Due to the development and implementation of storm water runoff regulations, the use of sumps is now common in parking lots, salvage yards, scrap yards, and anywhere that rain can combine with oil, grease, fuel, or other hazardous materials. The sumps are typically located in holes dug out of the pavement so that only their upper surface is exposed, allowing run-off to collect directly into the sump. The concrete or asphalt surrounding a sump is generally sloped to the sump to provide for gravitational flow and capture.

In current constructions, sumps are commonly constructed from a layer of concrete with a protective coating of tile, brick, or FRP. Other solutions include molded single wall tanks, however these tanks have a tendency to lift or "float" out of their hole and become either damaged or unusable. Anchored sumps of these types are traditionally expensive because the materials necessary to create the anchored sump are costly and there is relatively significant fabrication labor.

SUMMARY OF THE INVENTION

The present invention overcomes the shortcomings of the prior art and comprises a seamless, rotationally molded double wall sump. The seamless, one piece double wall design is unique to the industry and has inherent advantages over previous designs. The dual wall design provides insurance against leakage, and the seamless design prevents seepage or leaks from penetrating the sump. The double wall design may be molded with a fabric faced grating seat as an integral part. The design results in a cost effective, high performance solution that can be produced in large quantities with relatively little labor costs compared with previous sump manufacturing concepts. The double walls form a gap that may be filled with a foam stiffener to further increase the rigidity and strength of the sump.

For both retrofit and new construction, the sump of the present invention is cast-in-place using standard concrete materials and methods. That is, the sump is placed into wet cement formed in a pit and allowed to harden around the sump. The adjoining ground level is set such that any liquids within the immediate area will flow to the sump for further disposition which can include outlet piping for gravity flow to a larger collection tank. Or, the sump can be equipped with a level control device and relays to activate a pump for "lifting" or transferring the liquids to another location for storage and/or treatment. The integral ribs of the secondary containment portion of the sump function to "lock" the sump into the surrounding concrete to prevent flotation of the sump in "high water table/empty sump" conditions. The integral fabric face, which can be a polyester or polypropylene sheet, is located on the vertical side and top of the grating seat to allow the thermoplastic sump to be effectively integrated with the chemically resistant flooring system being applied to the surrounding concrete floor. This feature provides for the isolation of the interface between the sump and concrete.

DETAILED DESCRIPTION OF THE PREFERRED EMBODIMENTS

Figure 1:
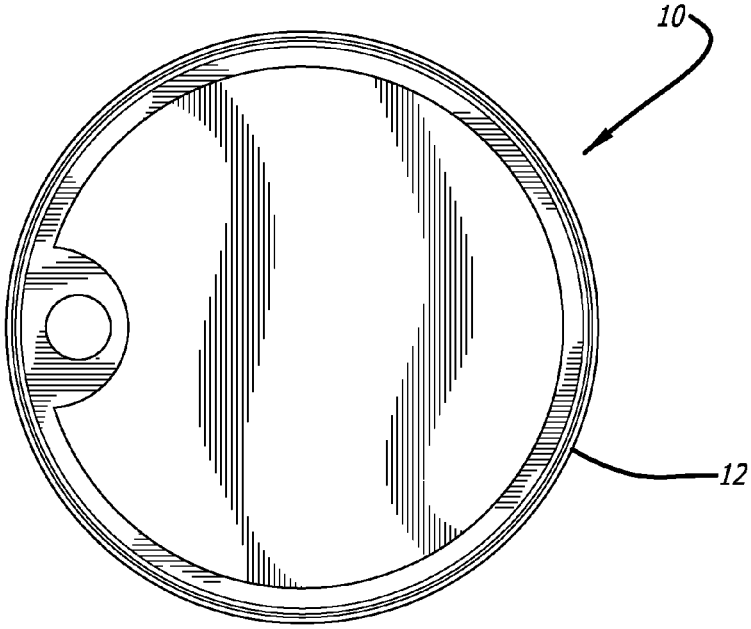
FIG. 1 is top view of the sump of the present invention without the grate.
Figure 2:
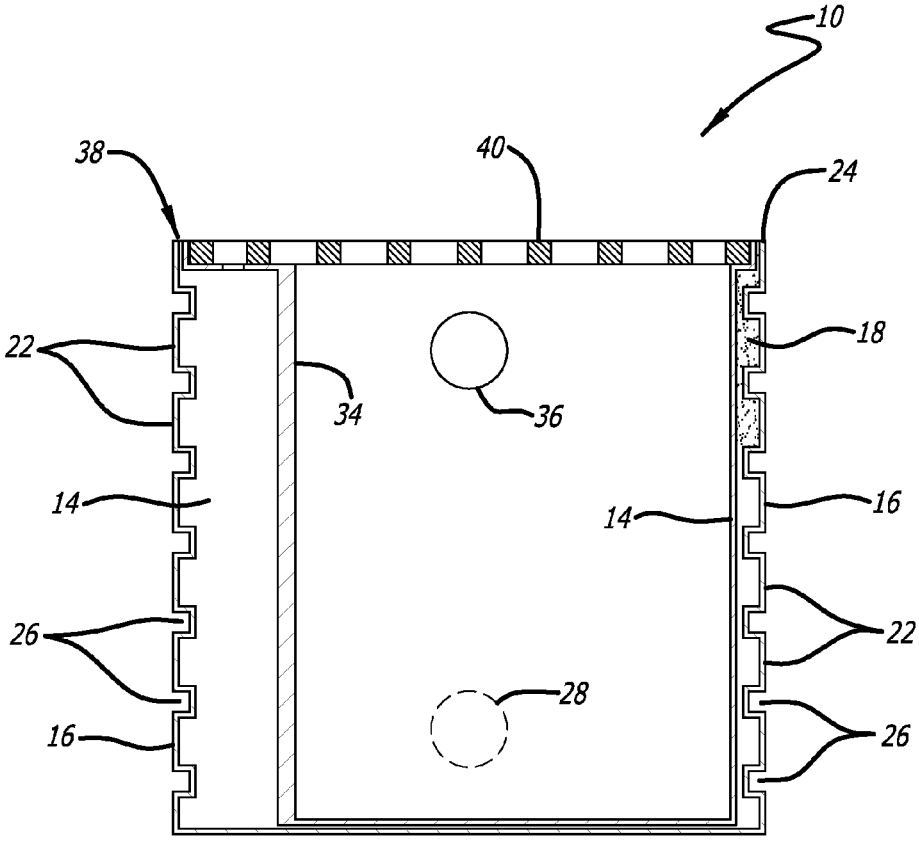
FIG. 2 is a cross sectional view of the sump of FIG. 1.
Figure 3:
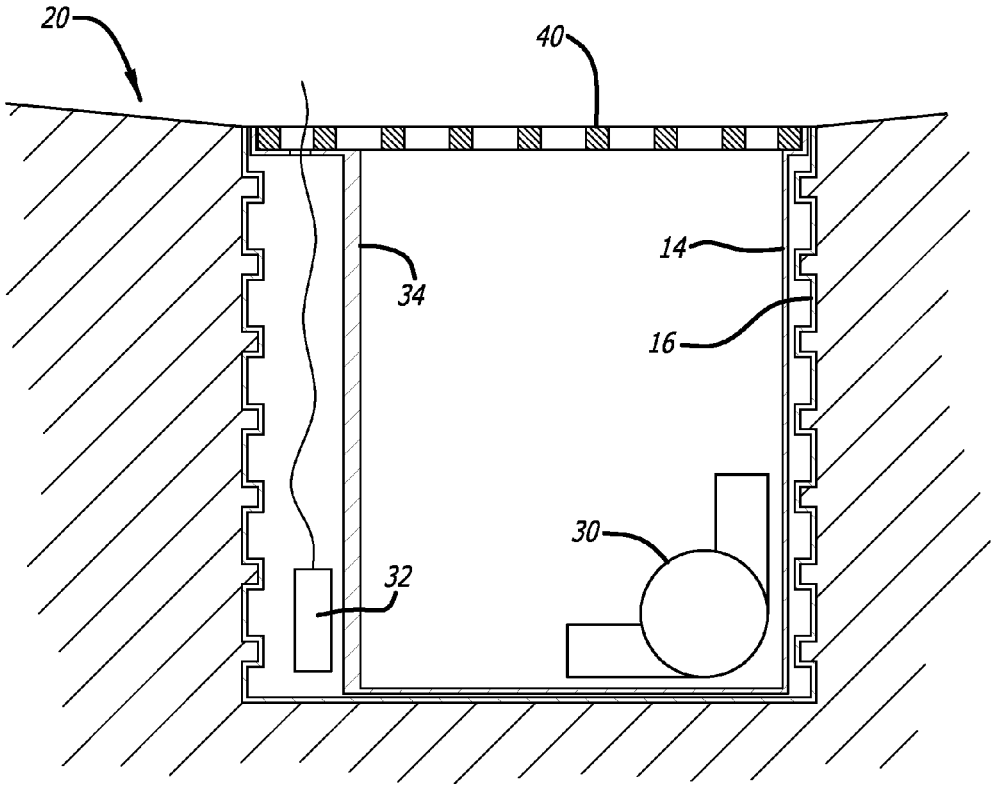
FIG. 3 is a cross-sectional view of the sump in ground with a pump installed to purge collected waste.

A sump 10 of the present invention is generally shown in FIGS. 1-3, comprising a cylindrical body 12 having two integrally molded vessels that form a double walled container. The first vessel 14 is a primary containment vessel that forms the interior of the sump 10 and is used to collect the various materials that the sump is designed to capture. The outer or secondary vessel 16 is a redundancy guard against leakage and is molded with the primary vessel to form a seamless integral one-piece unit of double wall construction. Between the two walls is a gap that may be filled with a stiffening foam 18 or other stiffening agent that can be injected between the two walls of the sump 10 during the molding process. The rigidity of the sump 10 is most critical at the upper portion of the sump, since the sump 10 is typically buried in the ground 20 (See FIG. 3) and surrounded by concrete. If the upper portion of the sump is flexible, it can separate from the concrete and create gaps at the surface between the secondary vessel and the ground that can allow contaminants to seep between the cement and the sump, leading to contamination, corrosion, and other deleterious effects.

The outer surface of the secondary vessel 16 is formed with a plurality of ribs 22 that protrude radially outward, preferably in concentric circles, and serve as anchors for the sump 10 to prevent the sump from lifting or "floating" in the concrete. First the ground is excavated and then wet cement is poured into the hole to create the base for the sump 10. Before the concrete sets, the double walled sump 10 is placed on the cement and additional cement poured around the walls to encase the sump 10 in wet cement until only the upper edge 24 of the sump 10 is visible in the concrete. The wet cement fills the gaps 26 between the ribs 22, and as the cement hardens the ribs 22 and the interleaving cement ridges formed in the gaps 26 prevent the sump from rising upward.

The sump 10 may be formed with a first port 28 along the lower surface that can be used to drain the sump as it fills with materials. Piping (not shown) connecting the sump through the port 28 can be gravity fed, so that as material collects when it reaches the port it is carried away under the influence of gravity to a collection area. Alternatively, the port and connecting piping can be coupled to a pump 30 that extracts the material collected in the sump. The pump 30 can be manually actuated, timer actuated, or it may be actuated upon the signaling of a fluid level sensor (not shown) incorporated into the sump. The level sensor determines the level of the collected waste in the sump 10, and sends a signal to the pump 30 when the level reaches a predetermined position or elevation in the sump to prevent overflow. Alternatively, the level sensor may send a signal to a processor (now shown) remote from the sump that can be used to actuate the pump 30 or other drainage measures.

The sump 10 may be configured with a leak detection sensor 32 to warn if the primary container 14 becomes compromised. If the primary container 14 forms a crack or loses integrity, waste will enter the area between the primary container 14 and the secondary container 16, collecting at the bottom of the gap between the two walls. If sensor 32 is placed at the bottom of the gap, it can send a signal to a nearby microprocessor to send an alarm that the sump needs repair.

The leak detector can be as standard detector that detects a change in resistance or capacitance when in contact with a liquid.

It is preferable to have the surround ground 20 area adjacent the sump contoured or sloped so that all run-off will collect into the sump via gravity. The sump may also have a second port 36 that leads other collection areas into the sump, such that the sump acts as a localized collection reservoir. The sump 10 may also preferably be formed with a circumferential upper lip 38 that retains a grate 40, such as a fiberglass grate, so that the opening of the sump 10 is not a hazard that workers can fall into.

The foregoing description is intended solely to be exemplary and not limiting as to the scope of the invention. There are many alterations and modifications that would be understood by one of ordinary skill in the art, and the invention is intended to include all such modifications, particularly as to pertains to use, materials, shape, dimension, and the like. For example, the sump could take on a rectangular shape without departing from the spirit or scope of the invention, or could be made from other materials suitable for the particular application. Thus, the invention should be construed to cover all such modifications and alterations, consistent with the language of the claims herein construed using their ordinary and customary meanings without limitation to anything depicted in the drawings or any descriptions above unless expressly limited.

I claim:

1. A method for collecting run-off material comprising the steps of:

forming a seamless, double walled thermoplastic sump having a primary containment layer and a secondary layer integrally molded together into a single unit, the sump including a plurality of ribs for anchoring the sump in surrounding concrete;

applying a fabric to the secondary layer to form an interface between the sump and the surrounding concrete;

excavating a hole at a desired location for the sump;

pouring concrete into the hole; and placing the sump into the concrete such that an upper surface of the sump coincides with an upper surface of the cement, and whereupon the ribs mesh with the concrete as it sets to prevent the sump from floating after the concrete dries.

* * * * *